US006618881B2

(12) United States Patent
Hart et al.

(10) Patent No.: US 6,618,881 B2
(45) Date of Patent: Sep. 16, 2003

(54) COVERING

(75) Inventors: Heath Hart, Charlotte, NC (US); Wang Ji, Syosset, NY (US)

(73) Assignee: Pem-America, New York, NY (US)

( * ) Notice: Subject to any disclaimer, the term of this patent is extended or adjusted under 35 U.S.C. 154(b) by 0 days.

(21) Appl. No.: 10/021,764

(22) Filed: Dec. 12, 2001

(65) Prior Publication Data

US 2003/0106152 A1 Jun. 12, 2003

(51) Int. Cl.[7] ..... A47G 9/02
(52) U.S. Cl. ..... 5/502; 5/482; 5/486
(58) Field of Search ..... 5/482, 486, 500, 5/502

(56) References Cited

U.S. PATENT DOCUMENTS

| | | | | | |
|---|---|---|---|---|---|
| 1,261,314 | A | | 4/1918 | Stoddard | |
| 1,347,642 | A | | 7/1920 | McNatt | |
| 1,569,955 | A | * | 1/1926 | Falter | 428/102 |
| 1,818,756 | A | | 8/1931 | Rosenbaum | |
| 2,263,810 | A | | 11/1941 | Leslie et al. | 5/334 |
| 2,810,921 | A | * | 10/1957 | Seidenberg | 5/501 |
| 2,821,723 | A | * | 2/1958 | Gluck | 5/501 |
| 3,355,748 | A | * | 12/1967 | Tuvert | 5/502 |
| 3,565,025 | A | | 2/1971 | Owen, Sr. | 112/420 |
| 3,801,420 | A | | 4/1974 | Anderson | 161/52 |
| 4,890,347 | A | | 1/1990 | Fuller | 5/508 |
| 4,903,361 | A | * | 2/1990 | Tang | 5/502 |
| 5,118,553 | A | | 6/1992 | Boisson | 428/99 |
| 5,146,634 | A | * | 9/1992 | Hunt | 5/486 |
| 5,836,023 | A | | 11/1998 | Stone Munson | 5/482 |
| 5,855,032 | A | | 1/1999 | Field | 5/502 |
| 6,261,397 | B1 | | 7/2001 | Repp et al. | 156/93 |
| 6,446,284 | B1 | * | 9/2002 | Yang | 5/502 |

* cited by examiner

*Primary Examiner*—Michael F. Trettel
(74) *Attorney, Agent, or Firm*—Jack Schwartz

(57) ABSTRACT

A covering sized to cover at least one of a bed, a sofa, a couch, a love seat, a chair and a recliner. The covering is for use as a decorative bed covering or a blanket providing extra warmth for a user. The covering includeds a quilt secured to a comforter by a connection device, preferably a nylon threaded. The quilt may be a finished quilt including a batting layer. The batting layer is positioned between the quilt and a top side of the comforter. Alternatively, the quilt may be unfinished, not including a batting layer. The comforter includes a top layer and a bottom layer each formed of a material selected from at least one of cotton, polyester-cotton blend, and remy-cotton blend. The quilt is formed of a material selected from at least one of wool, cotton, linen-cotton blend, and remy-cotton blend. The comforter also includes a middle layer preferably formed of at least one of down, a feather and down blend, and a down-cotton blend.

19 Claims, 8 Drawing Sheets

COVERING

BACKGROUND OF THE INVENTION

1. Field of the Invention

The present invention relates generally to coverings and, more specifically, to a bed covering including a patchwork quilt attached to a comforter, the covering being able to be used as a decorative covering for any of a bed, sofa, loveseat, couch, chair and recliner or a blanket providing warmth for a user as well as a decorative cover for the item on which it is placed.

2. Decription of the Prior Art

Numerous types of bed coverings have been provided in the prior art. For example, U.S. U.S. Pat. No. 5,855,032 discloses a quilt having three layers. The top layer is a quilt, the second layer is a filling or batting material, and the third layer is fur or synthetic fur. U.S. U.S. Pat. No. 3,565,025 discloses a blanket-bedspread combination. The blanket-bedspread combination includes an outer bedspread surface having a ribbed appearance and a blanket surface having a napped, raised fiber surface. The blanket-bedspread combination has a batt that extends widthwise through the combination giving support thereto. Furthermore, U.S. Pat. No 5,836,023 discloses decorative trim strips for comforters, quilts and the like. The decorative trim strips are made from a front and back panel whereby batting material is disposed between the front and back panel and is for use with a bed covering whereby a means to fasten the trim strip will be attached to the bed covering.

Additinally, U.S. Pat. No. 1,261,314 discloses removable quilt coverings. These covers are made of two separate pieces of fabric. One piece contains buttons while the second contains button holes. When matched up, the cover is secured around a quilt by the buttons thereby making it easily removable from the quilt. While U.S. Pat. No. 1,347,642 discloses a comforter consisting of a filling material and two outer coverings that are connected to each after being placed around the filling material. The two pieces of outer coverings are attached to one another by a lug and socket clasp. U.S. Pat. No. 1,818,756 discloses a quilted blanket consisting of an upper and lower blanket attached to each other. Filler material consisting of down, cotton, wool, or the like is placed between the upper and lower blanket prior to it being sewn together. The patent further teaches of a quilted blanket with a longitudinal pleat held together by an elastic strip that keeps the form of the pleat.

More examples of bed coverings are shown by U.S. Pat. No. 2,263,810 discloses a comforter wherein the filler material is contained within a series of individual sleeves or socks. The sleeves or socks are held together at one end by an adhesive means. The comforter is formed when the series of sleeves or socks are inserted into a series of pockets contained within a cover. Once inserted, the filler is secured within the cover by a zipper. U.S. Pat. No 3,801,420 discloses a plastic quilted bedspread having a vinyl top layer, a second layer of padding, a third interfacing layer that is partly stiff yet flexible, and a fourth bottom lining layer. All four layers are stitched together by a continuous stitching pattern. The top vinyl layer provides an ornamental quilting effect while the top layer of the plastic quilted bedspread gives a quilted effect. U.S. Pat. No 4,890,347 discloses interchangeable, detachable, decorative applique for a comforter or bedspread. The patent discloses different designs that can be removably attached to a comforter using hook and loop fasteners. Further, the patent speaks of the creation of a pocket for storage if not all edges of the design are secured to the comforter. U.S. Pat. No 5,118,553 discloses a decorative bed covering. The decorative bed covering consists of two panels, an upper and lower panel. The lower panel has one side of a fastening means sewn thereto whereas the upper panel has the other half of the fastening means attached thereto so that when the upper panel and lower panel are fit together, the fastening means is used to connect the upper panel to the lower panel. The suggested means for fastening the upper panel to the lower panel are button, snaps, velcro (hook and loop fasteners), or zipper. U.S. Pat. No. 6,261,397 discloses a method for making a quilt. The reference teaches that the quilt is made by putting a batting layer that has inactive adhesive between a top and bottom cover. Thereafter, the inactive adhesive is activated so as to form a temporary bond with the top and bottom covers. The top and bottom covers are then to be permanently secured together. The reference further teaches that the adhesive on the batting layer is heat activated and is water soluble which allows it to be removed after the quilt is formed.

While these units may be suitable for the particular purpose to which they address, they would not be as suitable for the purposes of the present invention as heretofore described.

It is therefore desirable to provide a covering which is able to serve as a decorative covering for any of a bed, sofa, couch, love seat, chair, recliner or the like. It is further desirable to provide a covering able to provide a user with additional warmth. It is still further desirable to provide a covering including a quilt which is attached to a comforter. It is yet further desirable to provide a covering including a batting layer to connect the quilt to the comforter. It is even further desirable to provide a covering wherein the quilt is a patchwork quilt, the patchwork quilt being attached to a down comforter. It is still further desirable to provide a covering wherein the quilt is an unfinished quilt, not including a backing layer. It is yet further desirable to provide a covering including a polyester or cotton bedding layer positioned between the quilt and comforter.

SUMMARY OF THE PRESENT INVENTION

The present invention relates generally to coverings and, more specifically, to a bed covering including a patchwork quilt attached to a comforter, the covering being able to be used as a decorative covering for any of a bed, sofa, loveseat, couch, chair and recliner or a blanket providing warmth for a user as well as a decorative cover for the item on which it is placed.

A primary object of the present invention is to provide a covering that will overcome the shortcomings of prior art devices.

Another object of the present invention is to provide a covering which is able to serve as a decorative covering for any of a bed, sofa, couch, love seat, chair, recliner or the like.

A further object of the present invention is to provide a covering that is used to provide additional warmth.

A yet further object of the present invention is to provide a covering including a quilt is attached to a comforter.

A still further object of the present invention is to provide a covering wherein the quilt attached to the comforter is a finished quilt including a batting layer.

A yet further object of the present invention is to provide a covering wherein the quilt attached to the comforter is unfinished, not including a backing layer.

An even further object of the present invention is to provide a covering wherein the quilt is a patchwork quilt, the patchwork quilt being attached to a down comforter.

A yet further object of the present invention is to provide a covering including a polyester or cotton bedding layer positioned between the quilt and comforter.

Another object of the present invention is to provide a covering that is simple and easy to use.

A still further object of the present invention is to provide a covering that is economical in cost to manufacture.

Additional objects of the present invention will appear as the description proceeds.

To the accomplishment of the above related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE PREFERRED EMBODIMENT

Figure 1:
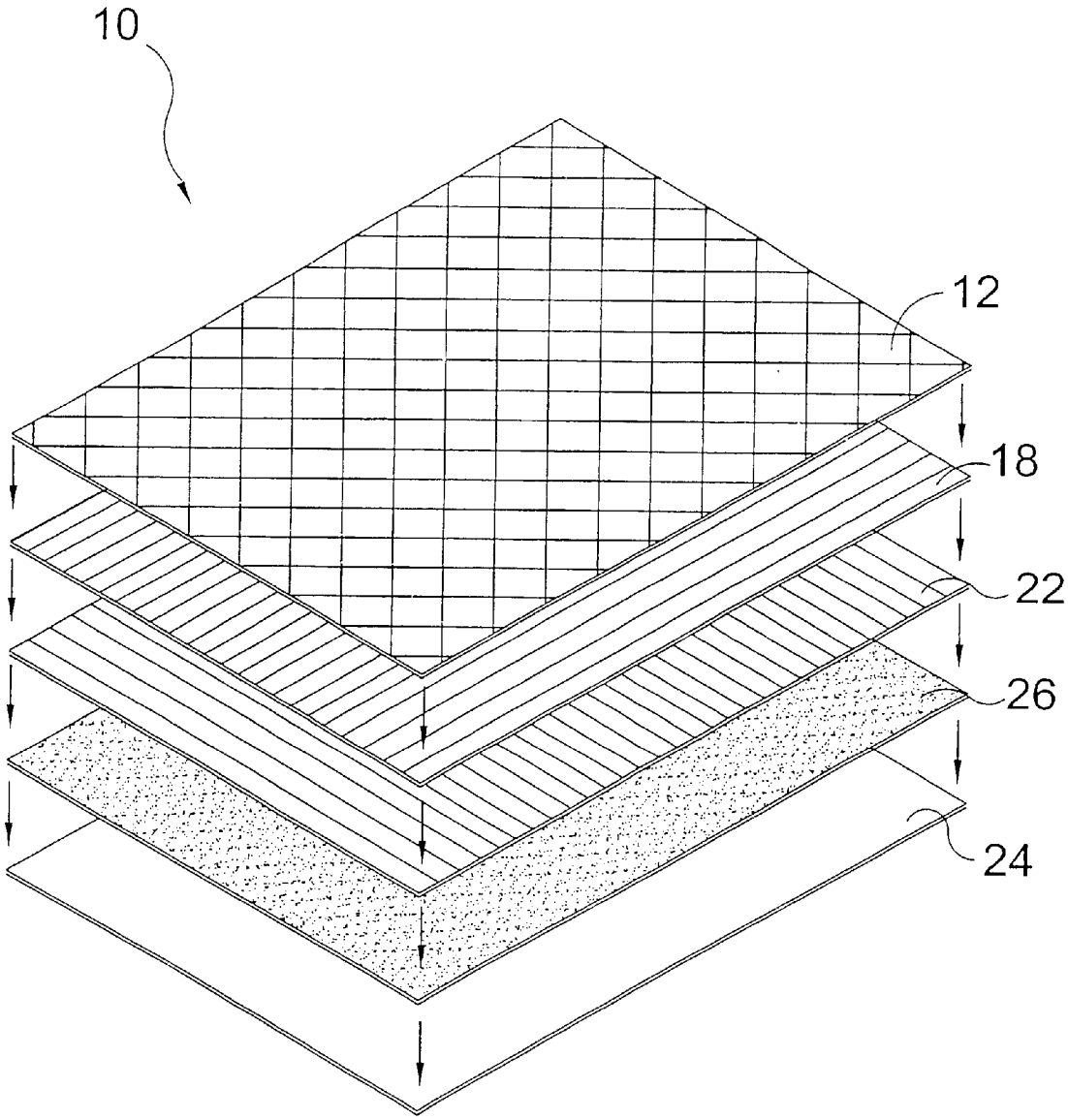
FIG. 1 is an exploded top perspective view of the covering of the present invention.

Turning now descriptively to the drawings, in which similar reference characters denote similar elements throughout the several views, FIGS. 1 through 9 illustrate the covering of the present invention indicated generally by the numeral 10.

FIG. 1 shows an exploded view of the covering 10 of the present invention. The covering 10 may be used as a quilt, throw, blanket or covering for a bed, sofa, couch, love seat, chair, recliner or the like. The covering 10 is formed of a quilt layer 12 and a comforter layer 20. The quilt layer 12 is finished or unfinished. The quilt layer 12 is finished when it is attached to a batting layer 18. The quilt layer 12 is unfinished when no batting layer 18 is present. Hereinafter, the phrase "quilt layer" is used interchangeably for a finished quilt or an unfinished quilt, unless specifically referenced otherwise. The quilt layer 12 is attached to the comforter layer 20 by a connecting device 14, as can be seen from FIG. 2. Preferably, the connecting device 14 is thread used to sew the quilt layer 12 and comforter layer 20 together. However, any known material or device for securing the quilt layer 12 and comforter layer 20 together may be used as the connection device.

While a preferred structure for the connecting device 14 is shown and described herein, those of ordinary skill in the art who have read this description will appreciate that there are numerous other structures for the connecting device 14 and, therefore, as used herein the phrase "means for connecting said quilt and said comforter together" should be construed as including all such structures as long as they achieve the desired result of securing the quilt and cover together, and therefore, that all such alternative mechanisms are to be considered as equivalent to the one described herein.

The material used to make the quilt 12 of the covering 10 is selected from at least one of cotton, wool, linen-cotton blend, and remy-cotton blend. The material used to make the comforter 20 of the covering 10 is selected from at least cotton, polyester-cotton blend, and remy-cotton blend. As shown in FIG. 1, the batting layer 18 is positioned between the quilt layer 12 and the comforter layer 20. The batting layer 18 is preferably formed from polyester, however cotton or a poly-cotton blend material may be substituted. As previously discussed, the batting layer 18 completes a finished quilt. The connecting device 14 attaches and secures the finished quilt layer 12 to the comforter 20 with the batting layer 18 positioned therebetween. The comforter 20 preferably includes three layers. A first top comforter shell layer 22 and a second bottom comforter shell layer 24 are attached to one another. An optional third middle layer 26 can be selectively incorporated into comforter portion 20 of the covering 10 between the first top layer 22 and second bottom layer 24. The middle layer 26 is a filling layer and adds to the functional use of the covering 10 by adding a layer to preserve warmth. Preferably, the middle layer 26 is formed of down. If the third middle layer 26 is formed from down, the first top layer 22 and second bottom layer 24 are preferably formed are down proof. Thus, the down is prevented from falling out of the comforter through either the top or bottom layers. The down is also prevented from causing allergic reactions to users of the covering 10 by the top and bottom layers 22 and 24. Alternatively, the middle layer 26 can be formed from cotton or a cotton-polyester blend. These other materials function to give the comforter thickness while also providing warmth to the user. This other embodiment is preferable in warmer climates. The connecting device 14 that connects the various layers of the covering 10 of the present invention is preferably formed from nylon stitching, however, any material suitable for connecting fabric layers to one another may be used in producing the covering of the present invention.

Figure 2:
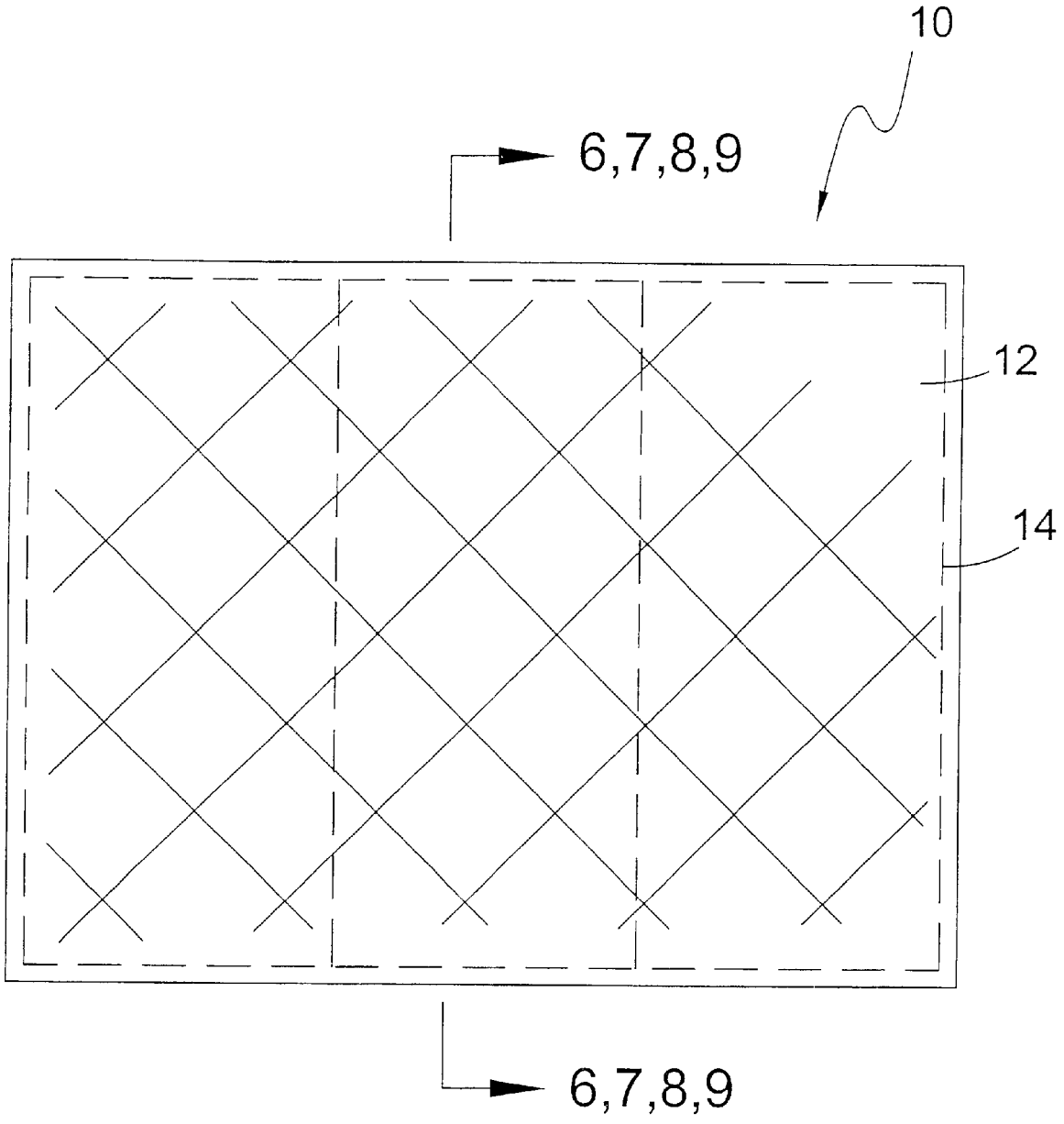
FIG. 2 is a top view of the covering of the present invention.

FIG. 2 shows a top view of the covering 10 of the present invention. This figure illustrates the quilt 12 being substantially the same size as the comforter 20. This is evidenced by the top comforter layer 22 not being visible from a top view. Alternatively, the comforter 20 may have an area slightly larger than the area of the quilt 12 whereby edges of the comforter 20 overlap edges of the quilt 12 to form a border around the edges of the quilt 12. Likewise, the quilt 12 may have an area slightly larger than the area of the comforter 20 whereby edges of the quilt 12 overlap edges of the comforter 20 to form a border around the edges of the comforter 20. Also shown are the connecting devices 14 which attach the quilt 12 to the comforter 20.

Figure 3:
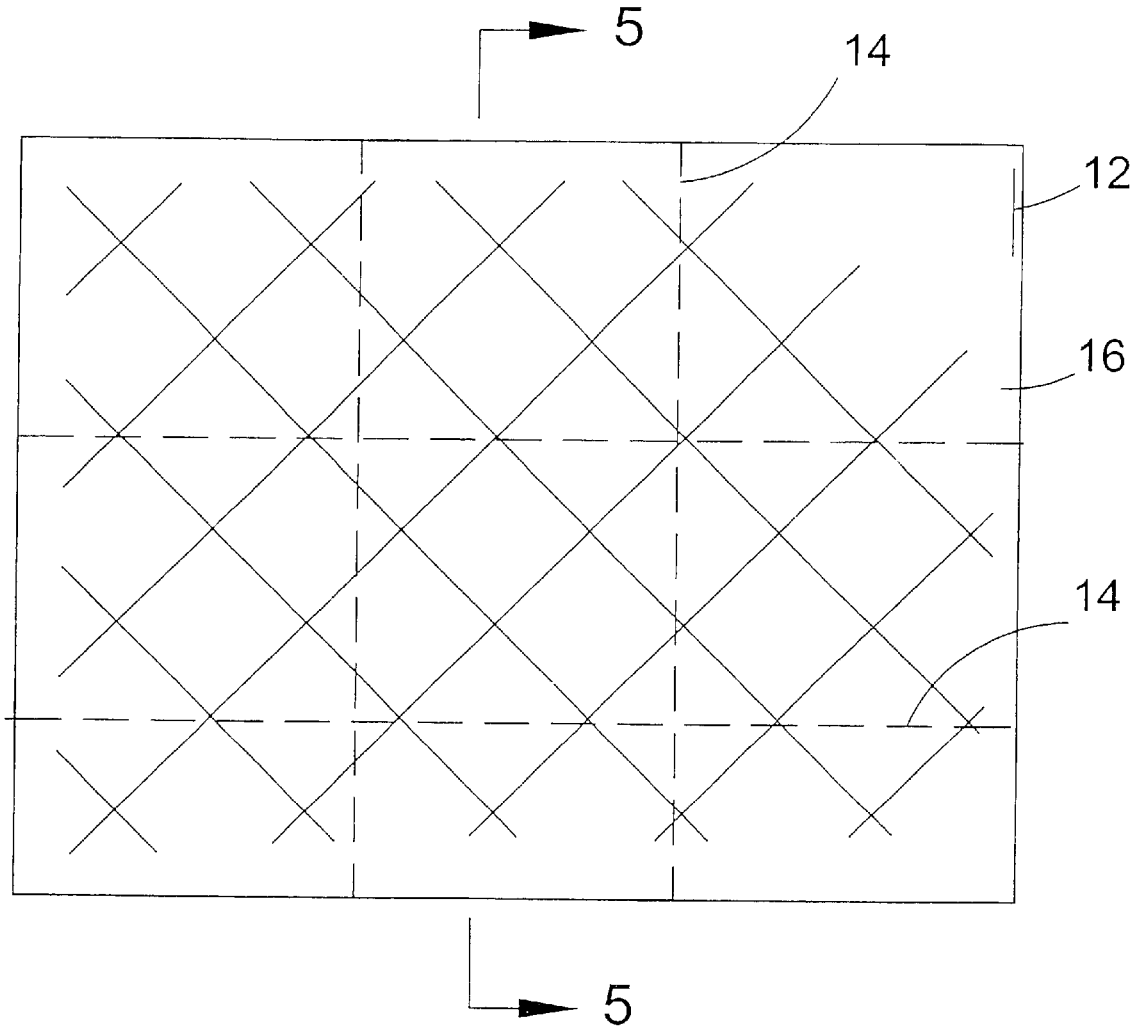
FIG. 3 is top view of the covering of the present showing the quilt side.

FIG. 3 is a top view of the covering 10 of the present invention illustrating the quilt 12. The quilt 12 is formed from individually attached swatches of material 16. As stated above, the material from which the swatches are formed is preferably selected from cotton, wool, linen-cotton blend, and remy-cotton blend. The individual swatches 16 are sewn or otherwise connected to one another until a desired size is reached. Each individual swatch 16 can have its own decorative pattern. Alternatively, each individual swatch 16 can be one piece of a larger decorative pattern that that is complete when all the individual swatches 16 are sewn or otherwise connected together.

Figure 4:
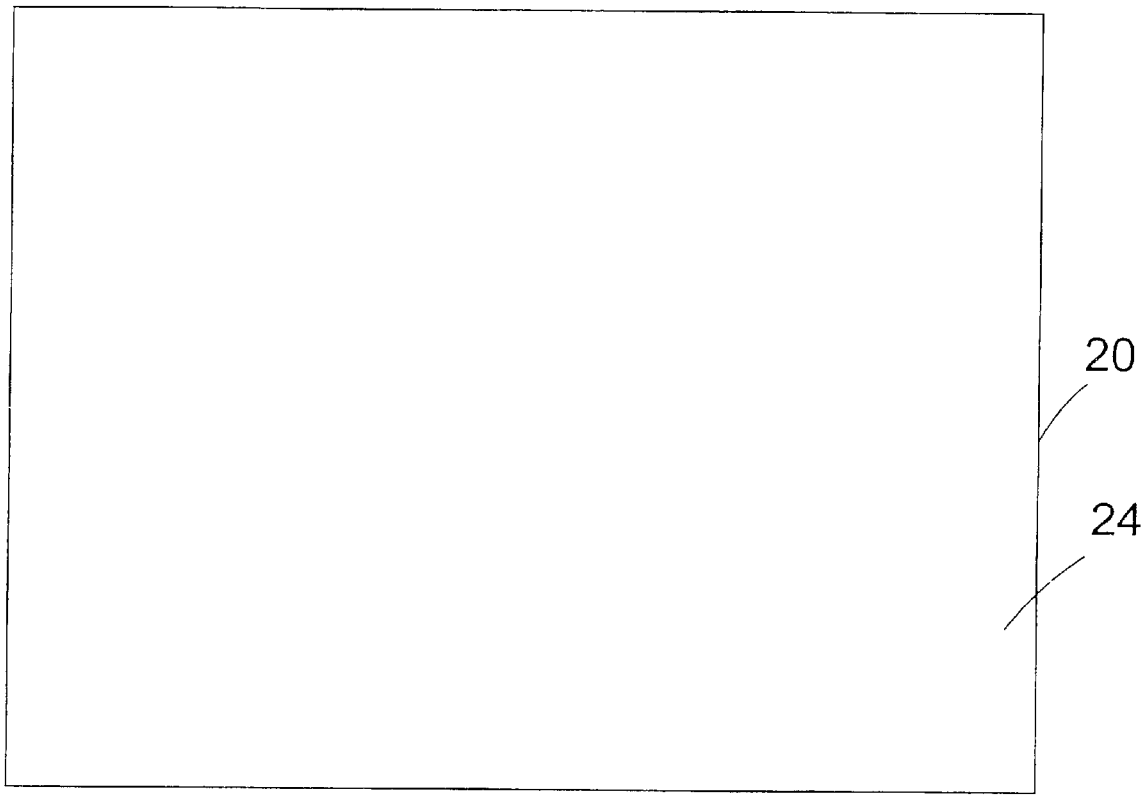
FIG. 4 is bottom view of the covering of the present invention showing the comforter side.

FIG. 4 shows a bottom view of the covering 10 of the present invention. Shown here is the bottom comforter layer 24 and the connecting device 14. The connecting device 14 extends through the quilt 12, batting layer 18, top comforter layer 22, optional middle layer 26, and bottom comforter layer 24. The bottom comforter layer 24 is preferably made from at least one of cotton, linen-cotton blend, or remy-cotton blend. However, any material which is soft to the touch and able to prevent the middle layer from falling out of the comforter 20 can be used.

Figure 5:
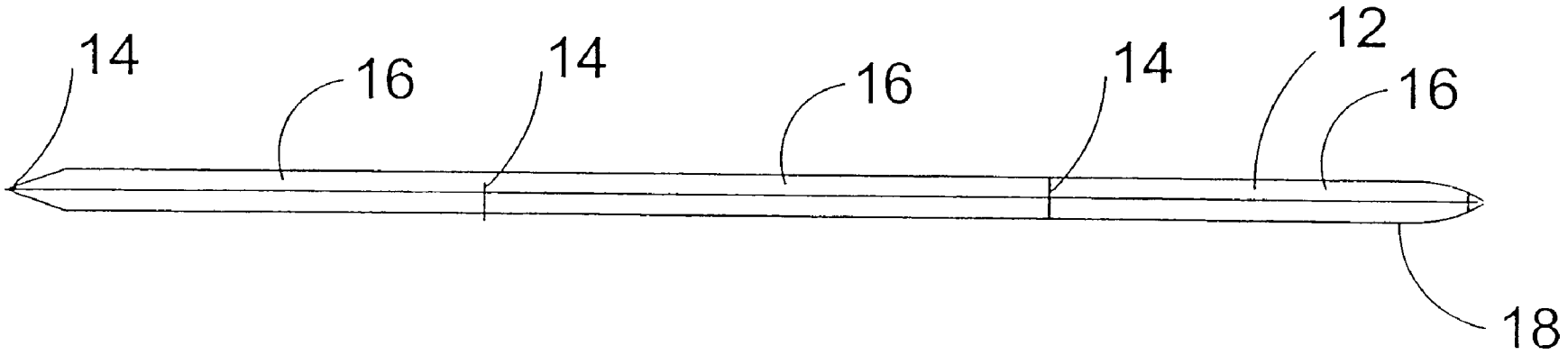
FIG. 5 is cross-sectional view of the quilt portion of the covering of the present invention.

FIG. 5 is a cross-sectional view of the quilt 12 taken along the line 5—5 of FIG. 3. This view shows the quilt 12 attached to the batting layer 18 via connecting devices 14. The quilt layer 12 is formed from the individual swatches 16. The material of the individual swatches 16 is preferably selected from at least one of cotton, wool, cotton-linen blend, and remy-cotton blend. The batting layer 18 to which the quilt 12 is attached is preferably formed from polyester, however cotton may be substituted.

Figure 6:
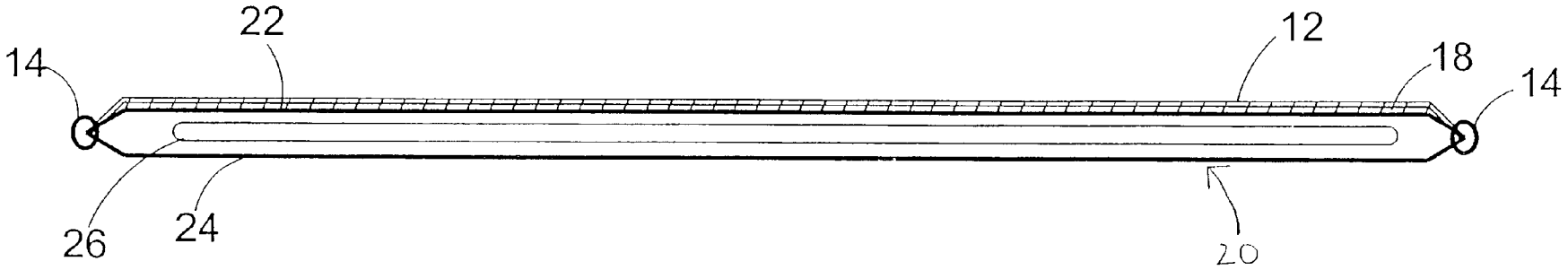
FIG. 6 is a cross-sectional view of a first embodiment of the covering of the present invention.

FIGS. 6, 7, 8, and 9 are cross sectional views of different embodiments of the covering 10 of the present invention taken along the line 6,7,8,9—6,7,8,9 in FIG. 2. FIG. 6 illustrates a cross-sectional view of the layers forming a first embodiment of the covering 10 of the present invention. Shown therein is the quilt 12 attached to the batting layer 18. The quilt 12 attached to the batting layer 18 completes the quilt to form a finished quilt. The quilt 12 and batting layer 18 are also attached to the comforter 20 with the batting layer 18 positioned between the quilt 12 and the comforter 20. The comforter 20 includes the top comforter layer 22, the middle layer 26, and the bottom comforter layer 24. The middle layer 26 is preferably formed from down, and the top and bottom comforter layers, 22, 24 respectively, are preferably formed from down proof material. The down proof material forming the top comforter layer 22 and bottom comforter layer 24 prevents the down from escaping from the comforter 20. However, any material able to retain the middle layer 26 between the top and bottom layers 22 and 24, respectively, without falling out may be used to form the comforter 20. Furthermore, any material able to provide thickness to the comforter as well as warmth to a user of the comforter can be used to form the middle layer 26.

Figure 7:
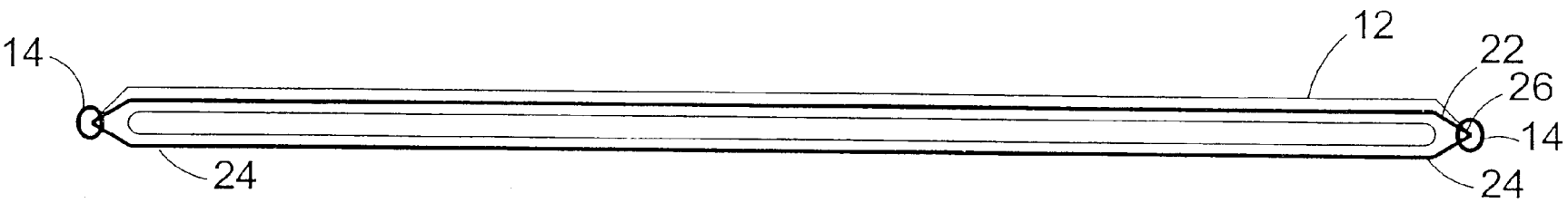
FIG. 7 is cross-sectional view of an alternative embodiment of the covering of the present invention.

FIG. 7 is cross-sectional view of an alternate embodiment of the covering 10 of the present invention taken along line 7—7 in FIG. 2. This figure shows the quilt 12, comforter top layer 22, middle layer 26, and comforter bottom layer 24. The quilt layer 12 in this figure is an unfinished quilt and is shown attached directly to the comforter top layer 22 by the connecting device 14. There is no bottom or batting layer connected to the quilt 12 to form a finished quilt. The comforter top layer 22 is also attached to the comforter bottom layer 24 by the connecting device 14. Positioned between comforter top layer 22 and comforter bottom layer 24 is the middle layer 26. The middle layer 26 is preferably formed from down, and the top and bottom comforter layers, 22, 24 respectively, are preferably formed from down proof material. The down proof material that comprises the top comforter layer 22 and the bottom comforter layer 24 prevents the down from escaping from within the comforter 20. Furthermore, any material able to provide thickness to the comforter 20 as well as warmth to a user of the comforter 20 can be used to form the middle layer 26.

Figure 8:
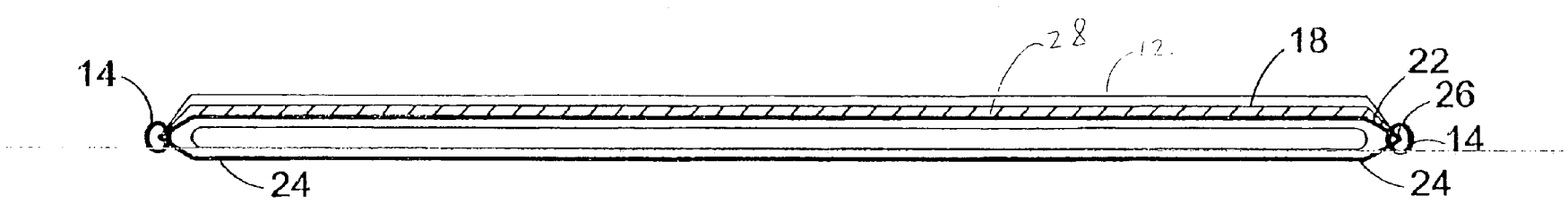
FIG. 8 is a cross-sectional view of a third embodiment of the covering of the present invention.

FIG. 8 is a cross-sectional view of a third alternate embodiment of the covering 10 of the present invention taken along line 8—8 in FIG. 2. This embodiment includes the quilt 12, batting layer 18, comforter top layer 22 and comforter bottom layer 24. Positioned between the batting layer 18 and the comforter top layer 22 is an additional layer 28. The additional layer is preferably formed of polyester, cotton or a polyester-cotton blend. The quilt 12 is attached to the batting layer 18 by the connecting device 14. Thereafter, the finished quilt formed from quilt 12 and batting layer 18 are attached to one side of the comforter top layer 22 by connecting device 14 with the additional layer 28 connected therebetween. The comforter bottom layer 24 is attached to the comforter top layer 22 on a side opposite the attachment of the quilt 12 to comforter top layer 22. The comforter bottom layer 24 is attached to the quilt 12 and the comforter top layer 22 by connecting device 14. The material comprising the top comforter layer 22 and the bottom comforter layer 24 of the covering 10 is selected from at least one of cotton, polyester-cotton blend, and remy-cotton blend. Positioned between the comforter top layer 22 and comforter bottom layer 24 is the middle layer 26.

The covering 10 of the present invention serves the primary purpose of increasing the users warmth and comfort. The covering 10 is a versatile accessory that can be used in many different situations. The preferred use of the covering 10 is that of a bed covering. The covering 10 can be made to fit the different dimensions of a common bed, such as twin, full, queen, king and extra long twin. The covering 10 can also be sized to act as a blanket or throw for covering any of a sofa, couch, loveseat, chair and recliner. The covering 10 including a quilt side 12 and a comforter side 24 can be used interchangeably as to which side is showing when in use. When the covering 10 is used as a blanket, it is preferred that the quilt side 12 is held closer to the user. The quilt 12 is made of a material such that it retains warmth and is comfortable and non-reactive when brought into contact with a users skin.

The covering 10 of the present invention can also be made is sizes smaller than a conventional bed. This alternate embodiment of the covering 10 can be used as a throw-covering for a couch whereby the specific design of the swatches 16 of the quilt 12 can be matched to a user's couch for additional decorative appeal. The smaller covering 10 can be in a folded position whereby it partially covers the portion of the couch where a user rests his or her back. The covering 10 can also be used in an open position whereby the covering 10 covers the entire sitting area of the couch. Furthermore, covering 10 can be used as a blanket if extra warmth is desired when a user is positioned on the couch. The quilt 12 is made from material such that it is comfortable and non-reactive with a users skin.

From the above description it can be seen that the covering of the present invention is able to overcome the shortcomings of prior art devices by providing a covering which allows for a decorative patterned quilt to be sewn to a comforter thereby providing a blanket that allows a user remain warm. The covering can be made in varying sizes for use as a bed covering or a throw covering over a couch. Furthermore, the covering is economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A covering comprising:

a) a patchwork quilt including a top layer and a backing layer connected to said top layer;

b) a comforter including a bottom layer and a filling layer positioned between said bottom layer and said backing layer of said patchwork quilt; and c) means for connecting said patchwork quilt to said bottom layer thereby producing a decorative covering able to provide warmth to a user wherein said connecting means sews said quilt to said comforter.

2. The covering as recited in claim 1, wherein said quilt further includes a batting layer, said batting layer being positioned between said top layer and said backing layer.

3. The covering as recited in claim 2, wherein said comforter further includes a top layer.

4. The covering as recited in claim 3, wherein said top least one of cotton, polyester-cotton blend, and remy-cotton blend.

5. The covering as recited in claim 1, wherein said top layer of said quilt is formed of a material selected from at least one of wool, cotton, linen-cotton blend, and remy-cotton blend.

6. The covering as recited in claim 2, wherein said quilt further comprises a middle layer positioned between said top layer and said batting layer.

7. The covering as recited in claim 1, wherein said filling is formed of a material selected from at least one of down, a feather and down blend, and a down-cotton blend.

8. The covering as recited in claim 7, wherein said top layer and said bottom layer of said comforter are formed of a material selected from at least one of cotton, polyester-cotton blend, and remy-cotton blend.

9. The covering as recited in claim 8, wherein said top layer of said quilt is formed of a material selected from at least one of wool, cotton, linen-cotton blend, and remy-cotton blend.

10. The covering as recited in claim 1, whereby said quilt is an unfinished quilt.

11. The covering as recited in claim 1, further comprising an additional layer positioned between said quilt and said comforter.

12. The covering as recited in claim 11, wherein said additional layer is secured between said quilt and said comforter by said connecting means.

13. The covering as recited in claim 11, wherein said additional layer is formed of a material selected from at least one of polyester, cotton or polyester-cotton blend.

14. The covering as recited in claim 11, wherein said quilt is a finished quilt including a batting layer secured thereto.

15. The covering as recited in claim 11, wherein said quilt is a finished quilt.

16. The covering as recited in claim 1, wherein said connecting means is formed of nylon thread.

17. The covering as recited in claim 1, wherein said covering is sized to cover at least one of a bed, a sofa, a couch, a love seat, a chair and a recliner.

18. The covering as recited in claim 1, wherein said quilt has an a area larger than an area of said comforter whereby edges of said quilt overlap edges of said comforter and are secured in overlapping fashion by said connecting means.

19. The covering as recited in claim 1, wherein said comforter has an area larger than an area of said quilt whereby edges of said comforter overlap edges of said quilt and are secured in overlapping fashion by said connecting means.

* * * * *